US005918814A

United States Patent [19]

Hough

[11] Patent Number: 5,918,814

[45] Date of Patent: Jul. 6, 1999

[54] SPRINKLER HEAD PROTECTOR

[76] Inventor: James S Hough, 7295 Rude St., Dalton Gardens, Id. 83815

[21] Appl. No.: 08/951,841

[22] Filed: Oct. 16, 1997

Related U.S. Application Data

[60] Provisional application No. 60/028,805, Oct. 17, 1996.

[51] Int. Cl.[6] ..... B05B 1/28

[52] U.S. Cl. ..... 239/288; 239/276

[58] Field of Search ..... 239/288, 288.3, 239/288.5, 276, 201

[56] References Cited

U.S. PATENT DOCUMENTS

| | | | |
|---|---|---|---|
| D. 256,386 | 8/1980 | Bergland | D23/7 |
| D. 314,419 | 2/1991 | Rosenfeld | D23/214 |
| D. 333,507 | 2/1993 | Colo'n | D23/213 |
| 3,762,642 | 10/1973 | Di Santo | 239/201 |
| 3,904,120 | 9/1975 | Sbicca | 239/201 |
| 4,146,181 | 3/1979 | Soos | 239/288.5 |
| 4,582,256 | 4/1986 | Jaquez | 239/288.5 |
| 5,211,338 | 5/1993 | Leite | 239/276 |
| 5,222,669 | 6/1993 | Lawson | 239/205 |

*Primary Examiner*—Andres Kashnikow
*Assistant Examiner*—Sean P. O'Hanlon
*Attorney, Agent, or Firm*—David S. Thompson

[57] ABSTRACT

Five embodiments of a sprinkler head protector provide an annular body defining a central hole and having a variety of differently designed spikes for retaining the body in place about a sprinkler head. A first version of the invention provides an annular body anchored by four large nails or spikes that may be driven into place by use of a hammer. A second version of the invention provides a one-piece unit including a body having four attached fastening spikes. A third version provides an annular body anchored by four spikes each having tapered top portions that insert into, and are frictionally engaged by, holes in the bottom of the annular body. A fourth version of the invention provides an annular body as in the first version, but provides four spikes which are attached to the body by fasteners such as screws. A fifth version of the invention provides an annular body 100 having four spikes which are threadedly attached to the body. In all of the above versions, a solid annular body may be used for extra strength, or to save costs, a semi-solid body having a lower surface combining web elements and partially enclosed hollow areas.

2 Claims, 6 Drawing Sheets

SPRINKLER HEAD PROTECTOR

CROSS-REFERENCES

This application is related to, and claims priority for, an earlier provisional application 60/028,805, filed Oct. 17, 1996.

BACKGROUND

The use of automatic sprinkler systems is becoming more and more widespread. Such systems save water by directing it exactly where it is needed and at the time of day when evaporative losses can be minimized, and save labor by eliminating the need to move hoses. However, such systems tend to have a high parts-count, including many parts which are vulnerable to damage from lawn mowing machinery, overgrown grass and other hazards. When an automatic sprinkler system breaks down the entire labor savings may be lost, due to the time and cost of repairing the system. The water savings may also be lost, if leakage results from a broken system.

For the foregoing reasons, there is a need for a sprinkler head protector that can be added to a variety of different existing sprinkler systems to protect the sprinkler heads. The sprinkler head protector must be able to prevent damage to the sprinkler head caused by an inadvertent blow from a lawn mower blade, or damage from the wheel of a mower. The sprinkler head protector must be designed to absorb the impact of any blow that could otherwise render the sprinkler head inoperative. The sprinkler head protector should also reduce or eliminate the growth of grass in the immediate area of the sprinkler head, which may prevent the proper operation of the sprinkler.

SUMMARY

The present invention is directed to an apparatus that satisfies the above needs. A novel sprinkler head protector provides some or all of the following structures.

(A) An annular body defining a central hole sized for passage of the sprinkler head allows the annular body to be placed around the upper portion of the sprinkler head. In a version of the sprinkler head protector seen in FIGS. 1–4, the annular body typically includes:

(a) A curved annular upper surface, defining a plurality, typically four, counter sunk areas, each counter sunk area having an associated shoulder surface.

(b) A lower surface is adjacent to the outer perimeter of the curved annular upper surface. The lower surface is typically formed of web elements partially enclosing and defining hollow areas, in a manner that provides strength, low-cost and light-weight.

(c) A plurality—typically four—of radially arrayed attachment holes passes entirely through the annular body. Each attachment hole allows for attachment of a spike, and has a lower opening defined within the web elements of the lower surface of the annular body and has an upper opening defined within a shoulder surface of one of the counter-sunk areas.

(d) One circular boss is associated with each attachment hole. Each boss is defined by web elements adjacent to one of the attachment holes, and provides increased structural strength.

(B) One spike is associated with each attachment hole, and has a head portion sized to rest on the shoulder surface of a counter sunk area. Each spike provides a body portion extending from the lower surface and is adapted to secure the annular body in place in the ground surrounding a sprinkler head.

It is therefore a primary advantage of the present invention to provide a novel sprinkler head protector that will protect sprinkler heads from damage caused by lawn mower blades and various types of wheeled vehicles.

The disclosed sprinkler head protector also tends to protect the sprinkler from damage that may result due to a settling of the soil in the area of the sprinkler head due to compaction of soil that was loosened during the installation process.

The sprinkler head protector also prevents unwanted and overgrown grass, which may prevent the proper operation of the sprinkler head.

A further advantage of the present invention is to provide a sprinkler head protector that is suitable for either new construction or previously installed, existing, sprinkler heads.

DRAWINGS

These and other features, aspects, and advantages of the present invention will become better understood with regard to the following description, appended claims, and accompanying drawings where:

DESCRIPTION

Figure 1:
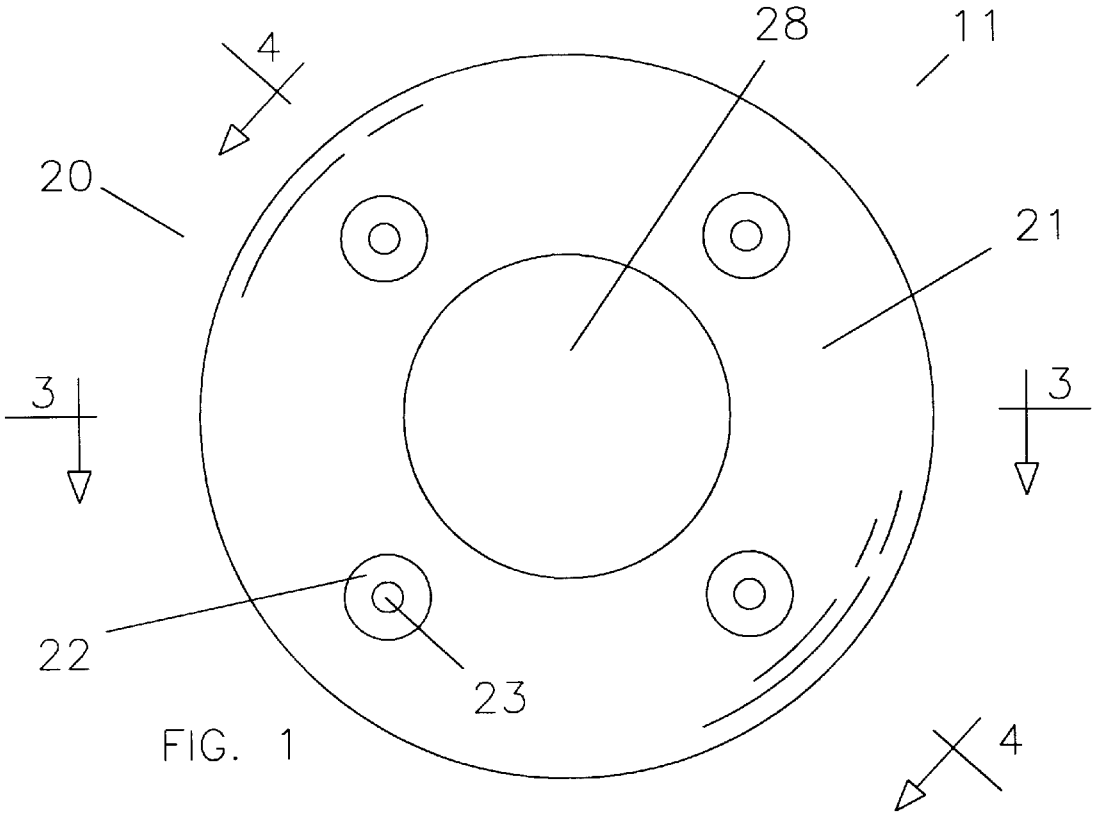
FIG. 1 is a top orthographic view of a first version of the annular body of the sprinkler head protector of the invention.

Referring in general to the figures, a sprinkler head protector 10 constructed in accordance with the principles of the invention is seen. Five embodiments of the invention are disclosed and illustrated. Each embodiment of the sprinkler head protector 10 provides a body 11 defining a central hole and having anchor means 12 for retaining the body in place about a sprinkler head 200. A first version of the invention provides an annular body 20 anchored by four large nails or spikes 60 that may be driven into place by a hammer. A second version of the invention provides a one-piece unit comprising a body 30 having four attached fastening spikes 70. A third version provides an annular body 40 anchored by four spikes 80 having tapered top portions that insert into, and are frictionally engaged by, holes in the bottom of the body 40. A fourth version of the invention provides an annular body as in the first version, but provides four spikes 90 which are attached to the body 20 by fasteners such as screws. A fifth version of the invention provides an annular body 100 having four spikes 110 which are threadedly attached to the body 100. The above versions of the invention may be constructed with a solid body for extra strength, or alternatively a body having a lower surface comprising web elements partially enclosing and defining hollow areas.

The preferred embodiments of the versions of the sprinkler head protector disclosed herein are made of known plastic materials by known manufacturing means. Possible materials for use in the manufacturing process are high-impact polyethylene, ABS plastic or high-impact polyurethane. However, many materials could be used for the manufacture, as is well-known to those in the plastic industry.

All versions of the invention have a body having a curved upper surface, which tends to better protect the sprinkler head, and is less likely to be snagged by anything moving across the lawn. Similarly, the annular body of all versions of the invention have a beveled edge about a lower opening of a central hole, which allows easier installation about a sprinkler head.

Figure 2:
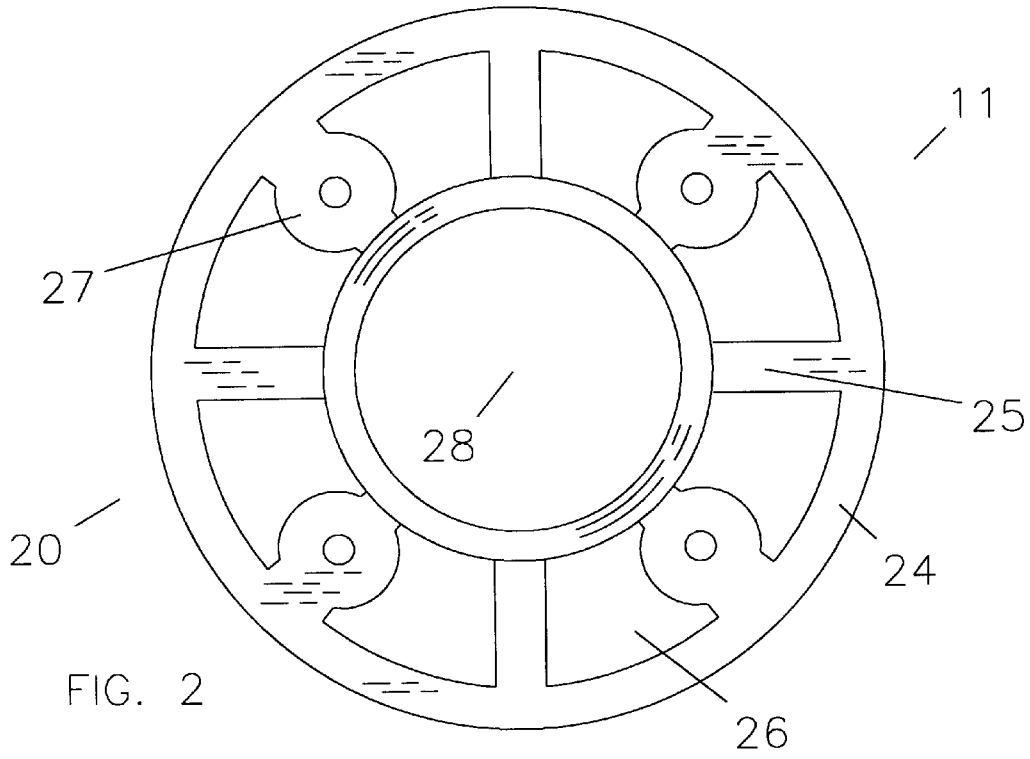
FIG. 2 is a bottom orthographic view of the annular body of FIG. 1.
Figure 3:
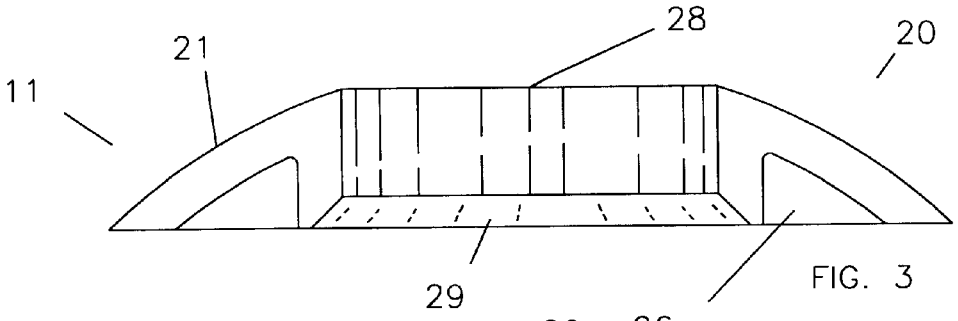
FIG. 3 is a cross-sectional view of the annular body of FIG. 1 about the 3—3 lines.
Figure 4:
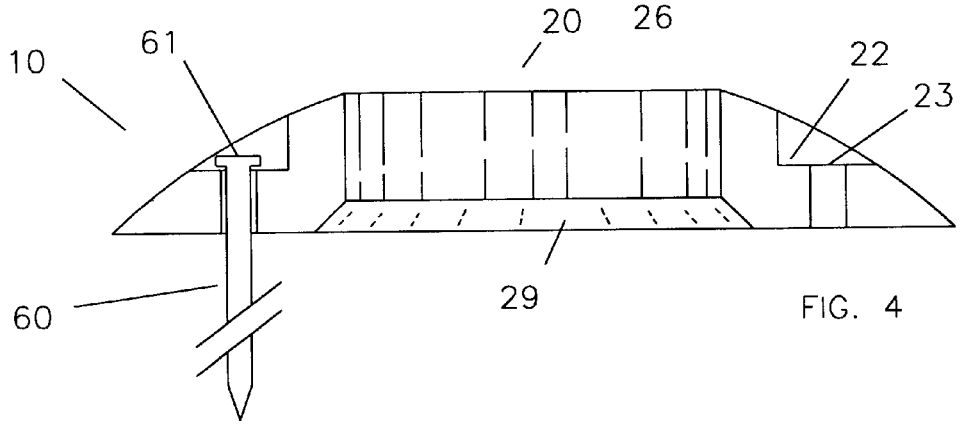
FIG. 4 is a cross-sectional view of the annular body of FIG. 1 about the 4—4 lines.

Referring to FIGS. 1 through 4, the first version of the invention is seen. This version of the invention comprises the annular body seen in FIGS. 1–3 and the anchoring means seen in FIG. 4. In this version of the invention, the annular body 11 includes a disk 20 defining a central hole 28, with a lower beveled edge 29. The hole 28 is sized to allow a sprinkler head to protrude. The anchor means in this version of the invention includes four nail-like spikes 60, as seen in FIG. 4, which may be driven with a hammer.

Figure 19:
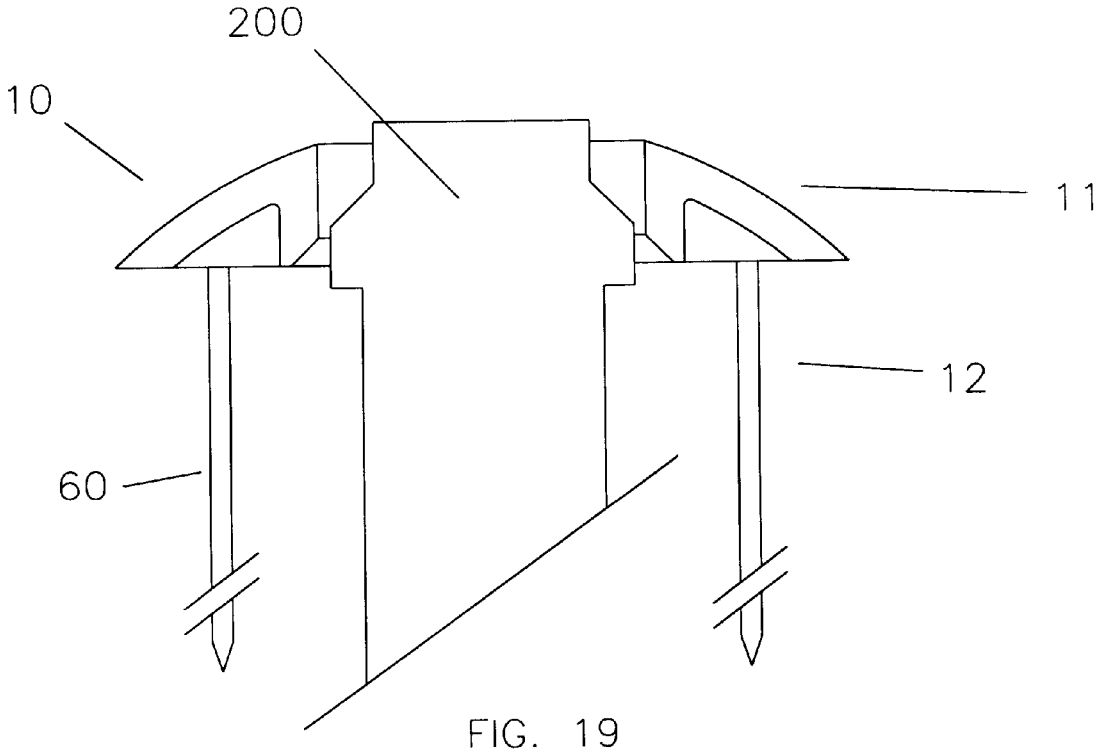
FIG. 19 is a view of a side orthographic view of a version of the invention installed around a sprinkler head.

As seen in FIG. 1, the disk provides an upper surface 21, having a curvature that is best seen in the cross-sectional views of FIGS. 3 and 4. Four spike attachment holes 23 having annular shoulders 22 with a counter-sunk area are radially arrayed about the disk, and provide locations through which large nails 60 or spikes may be inserted to anchor the disk in the soil after it is positioned over a sprinkler head as seen in FIG. 19. A planar lower surface 24 is seen in FIG. 2. To maximize strength, while minimizing weight and cost, the lower surface comprises a mixture of areas of web 25 and recessed hollows 26. Radially arrayed circular bosses 27 provide strength in the areas adjacent to the holes 23 which are provided for the anchoring spikes.

As seen in FIG. 4, nail-like spikes are inserted from the top of the disk, and are typically pounded into place by a hammer. Nail heads 61 rest on shoulders 22 within counter-sunk areas, thereby preventing unwanted movement of the disk 20.

Figure 5:
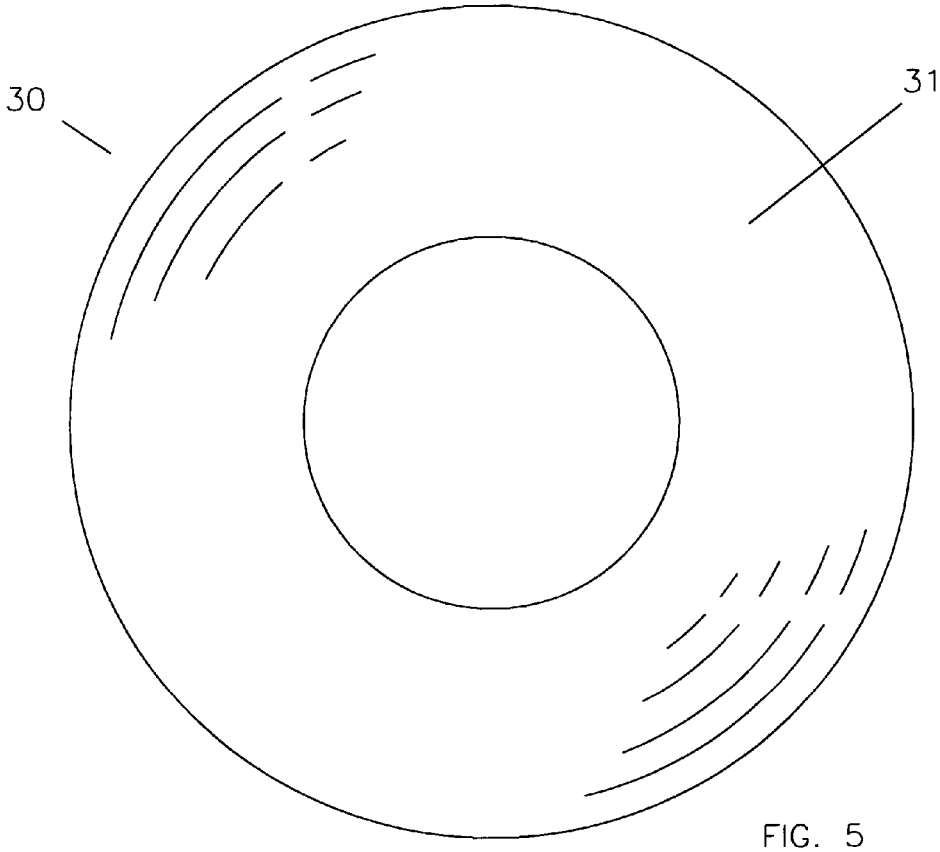
FIG. 5 is a top orthographic view of a second version of the annular body of the invention.
Figure 6:
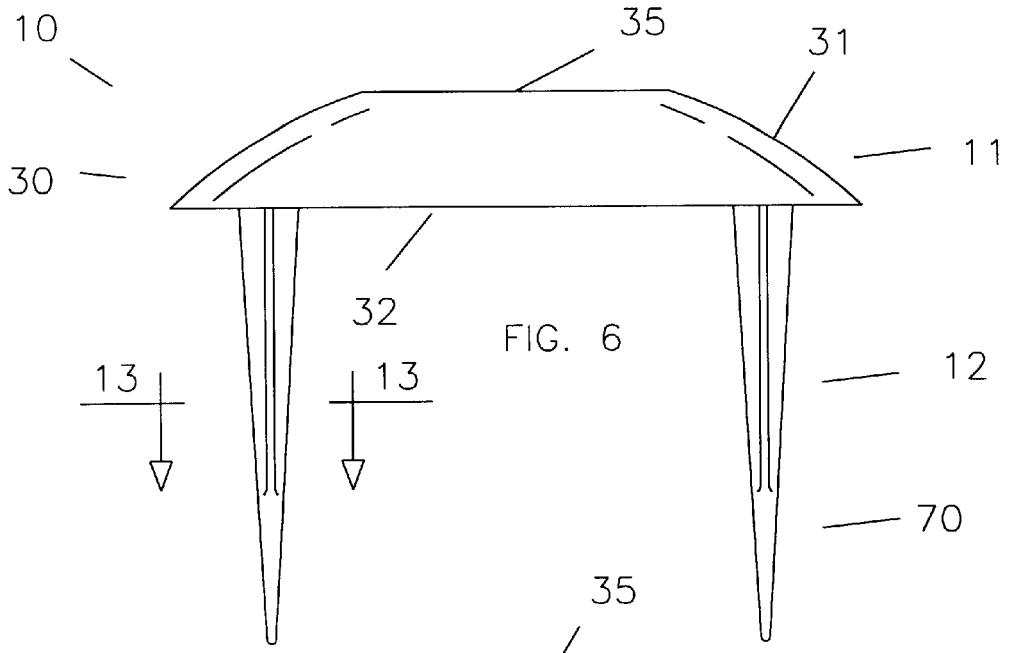
FIG. 6 is a side orthographic view of the second version of the invention.
Figure 7:
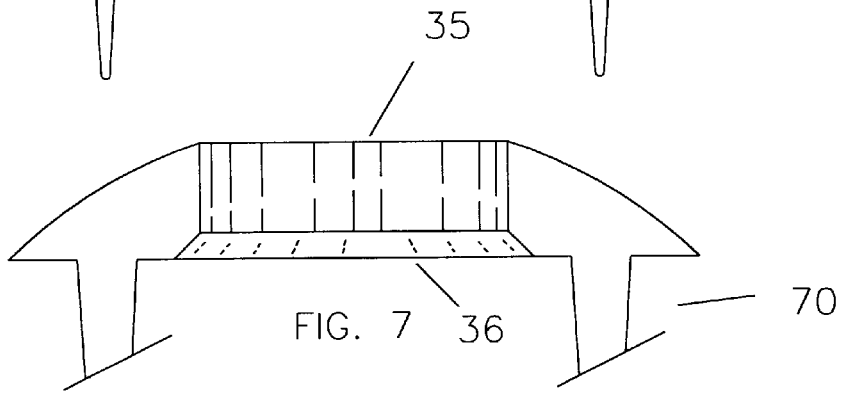
FIG. 7 is a cross-sectional view of the version of the invention of FIG. 6.

Referring to FIGS. 5 through 7, the second version of the invention is seen. This version of the invention comprises a body and spikes that are formed of a single piece of molded plastic. In this version of the invention, the annular body is a disk 30, having a central hole 35 with a beveled edge 36. The hole 35 is sized to allow a sprinkler head to protrude. The anchor means in this version of the invention include attached spikes 70, as seen in FIGS. 6 and 7.

Disk-like annular body 30 provides upper and lower surfaces 31, 32 similar to annular body 20. The upper surface 31 is curved, as seen in in both FIGS. 6 and 7. Web elements, seen when viewing the lower surface, provide strength and define hollow areas, which reduce the weight and cost of the body.

As seen in FIGS. 6–7, four attached spikes 70 are typically formed of the same piece of material used to form the body 30. The spikes 70 are tapered, in a manner similar to that of the tapered body 82 of the spike 80 seen in FIG. 12. The spikes 70 also have a cross-section similar to that seen in FIG. 13, that is calculated to result in a high ratio of strength to weight.

Referring to FIGS. 8, 9, 12 and 13 a third version of the invention is seen. This version of the invention comprises an annular body seen in FIGS. 8 and 9 and anchoring means seen in FIGS. 9, 12 and 13.

An annular body in the form of disk 40 provides a curved upper surface 41 defining a hole 47 having a beveled lower perimeter 48 for passage of a sprinkler head, and also having four radially arrayed tapered attachment holes 42 for receiving four taper head spikes 80.

A boss, similar to boss 27 seen in FIG. 2, reinforces the area about each spike hole 42. A planar lower surface 43 provides web elements which define hollow areas, which reduce the weight and cost of the body.

Figure 13:
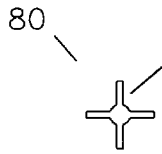
FIG. 13 is a cross-section of the taper head spike of FIG. 12, taken along the 13—13 lines.
Figure 12:
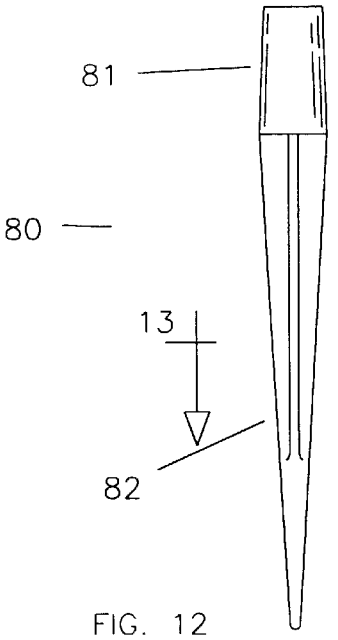
FIG. 12 is a side orthographic view of a taper head spike, usable with the annular body seen in FIGS. 8 and 9.

Anchoring means in the form of taper head spikes 80 provide a tapered conical head 81 and a spike body 82 having a cross-section seen in FIG. 13. The tapered conical head is sized to be inserted into a hole 42 in the disk 40, where friction will hold it in place. The tapered nature of the attachment holes 42 and the tapered head 81 of the spike 80 results in each spike being forced further into the holes 42 when pressure is applied to the top of the disk 40. Therefore, stepping on the disk tends to tighten the connection between the disk and spikes. To remove the spike 80 from the disk 40, the user may strike the upper end of the spike, visible from the top in FIG. 8, with a tool. The spike body 82 is formed in a configuration, as seen in FIGS. 12 and 13, that is calculated to provided both strength and light weight.

Figure 10:
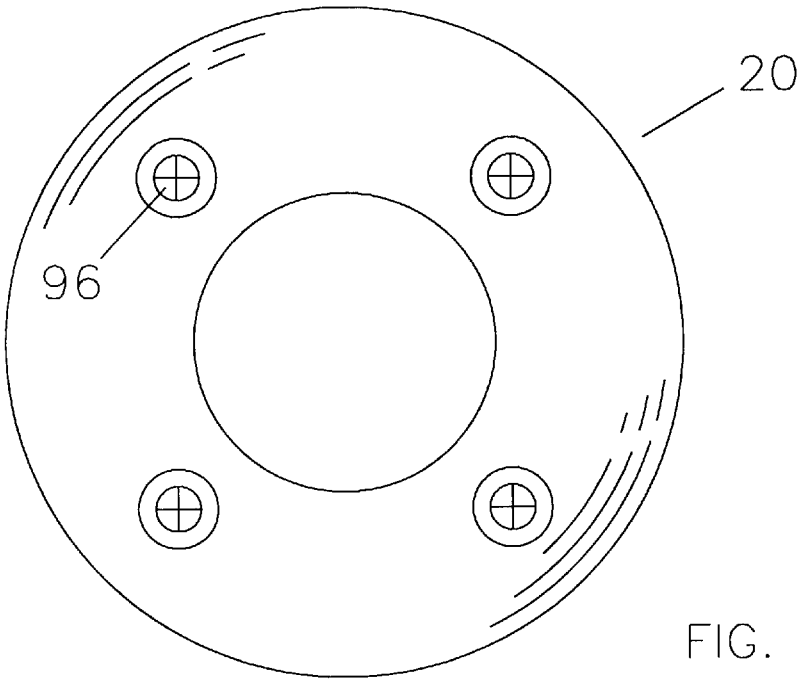
FIG. 10 is a top orthographic view of a fourth version of the sprinkler head protector of the invention.
Figure 11:
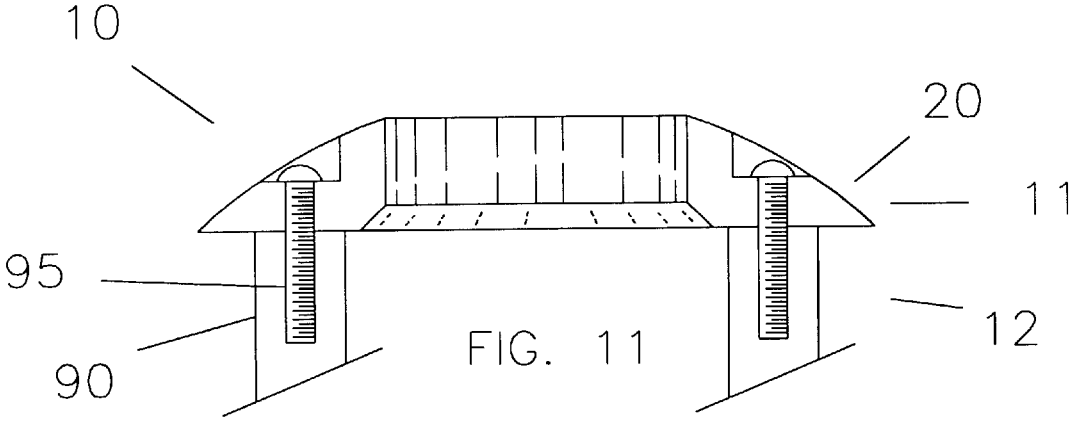
FIG. 11 is a cross-section of the sprinkler head protector of FIG. 10.

Referring to FIGS. 10 and 11, a fourth version of the invention is seen. This version of the invention comprises the annular body 20 seen previously described and seen in FIGS. 1–4 and the anchoring means seen in FIGS. 14 and 15.

Figure 15:
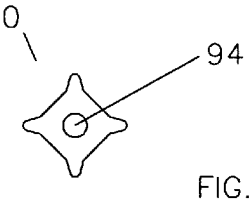
FIG. 15 is a cross-section of the taper head spike of FIG. 14, taken along the 15—15 lines.
Figure 14:
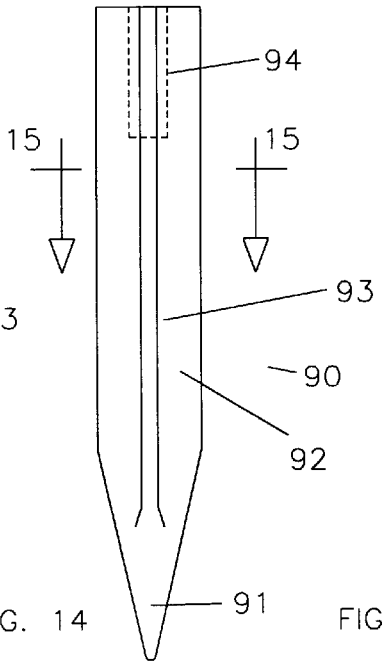
FIG. 14 is a side orthographic view of a spike attachable by a screw or other fastener and usable with the annular body seen in FIGS. 1–4, 10–11.

In this version of the invention, the anchoring means includes screw-on spikes 90 of a design that may be understood by review of FIGS. 11, 14 and 15. A point 91 is rounded, while the body 92 provides four lengthwise vertical ribs 93 to resist any tendency to bend. A threaded socket 94 allows for the easy insertion of a screw or bolt 95. After installation, the head 96 of the screw 95 rests on the shoulder 22 of the body 20. The sprinkler protector may then be inserted into the ground, surrounding the head of a sprinkler.

Figure 16:
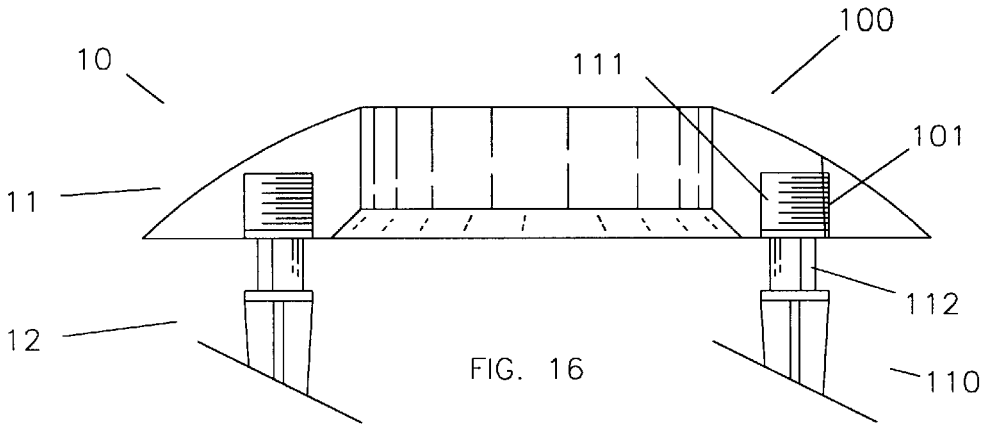
FIG. 16 is a side cross-sectional view of a fifth version of the sprinkler head of the invention.
Figure 17:
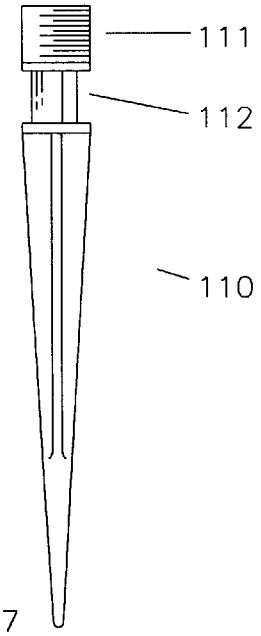
FIG. 17 is a side orthographic view of the spike used with the version of the invention seen in FIG. 16.

A fifth version of the invention is seen in FIGS. 16 and 17. This version of the invention comprises the annular body similar to that previously described and seen in FIGS. 8 and 9, but having modifications seen in FIG. 16, and the anchoring means seen in FIG. 17, which is a variation of the structures already described and seen in FIG. 12.

Figure 8:
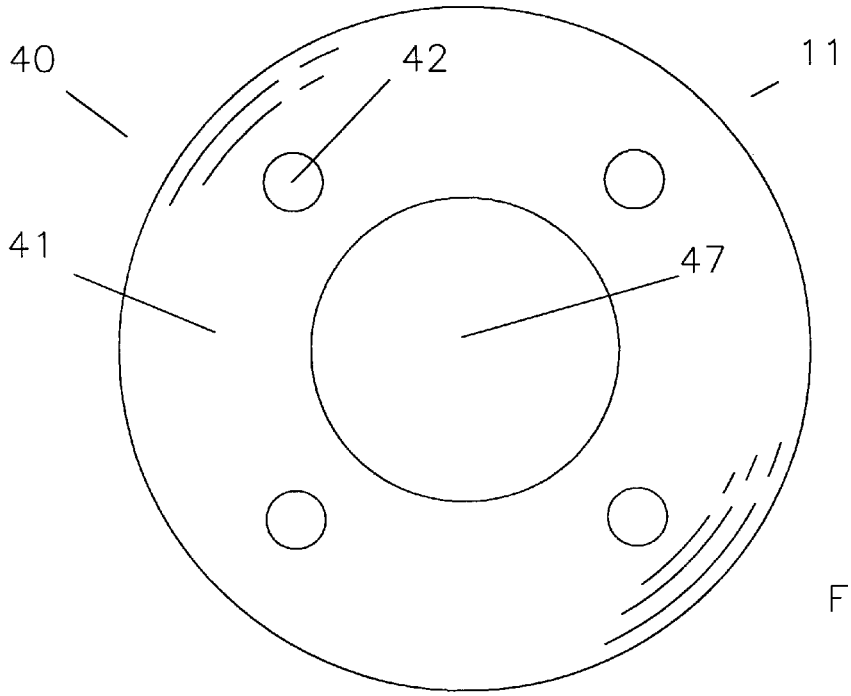
FIG. 8 is a top orthographic view of a third version of the annular body of the invention.
Figure 9:
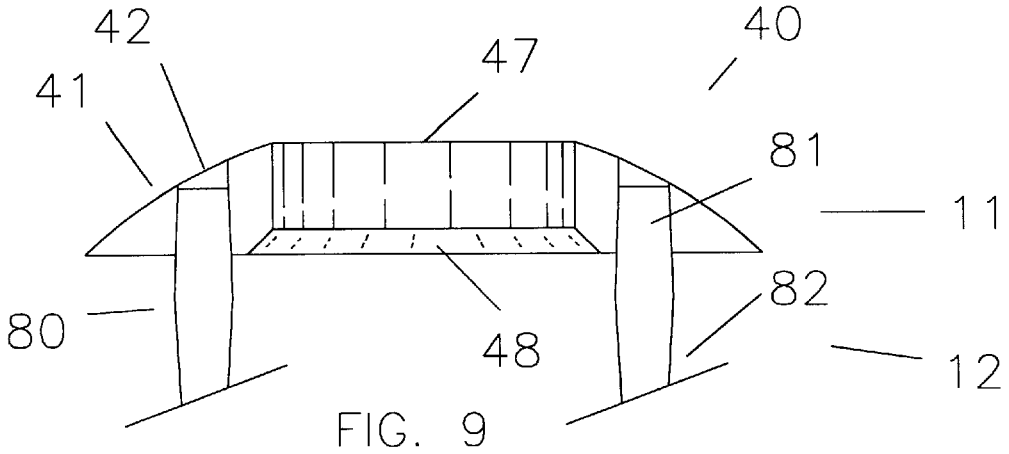
FIG. 9 is a cross-section of the version of the invention of FIG. 8.

As seen in FIG. 16, the disk body 40 of FIGS. 8 and 9 is modified to provide a disk body 100 having a threaded socket 101 in place of the tapered hole 42. As seen in FIG. 16, the socket 101 typically does not extend completely through the disk body. The threaded socket allows the installation and removal of a threaded spike 110.

The threaded spike 110, seen in FIG. 17 is similar to the spike seen in FIG. 12, but additionally provides a threaded head 111 which is sized to threadedly engage the threaded socket 101 of the disk body 100. Wrench flats 112 allow the use of a wrench to install the spike.

Figure 18:
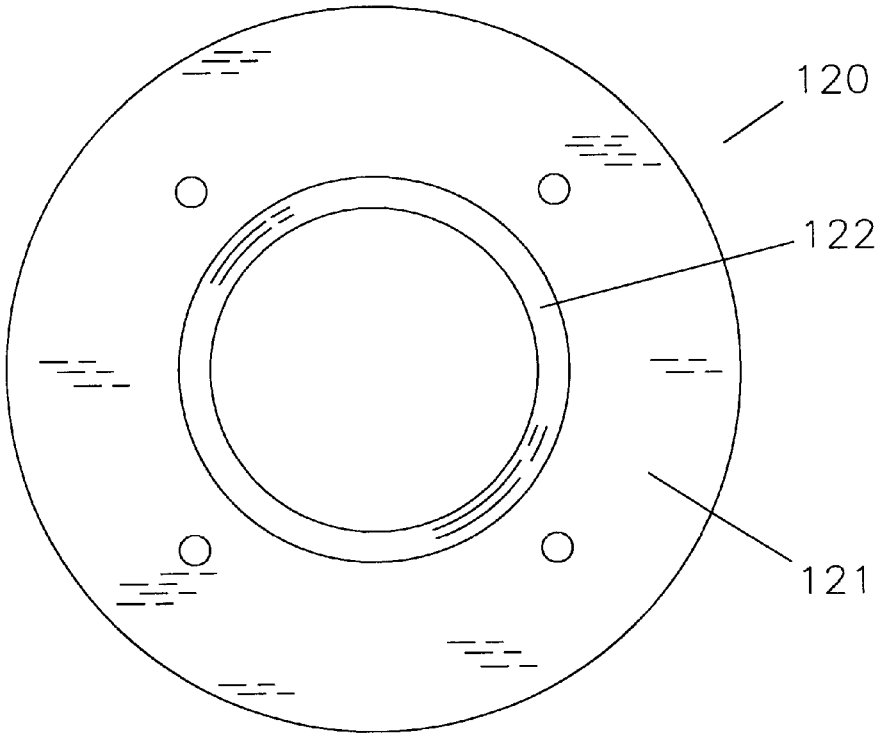
FIG. 18 is a bottom orthographic view of an alternate construction usable with several versions of the invention having a solid body with no web elements or hollow areas.

As seen in the bottom orthographic FIG. 18, a modification of any of the above versions of the invention provides a solid body 120 having a flat bottom surface 121 with no webbing or hollow areas and a beveled edge 122. This modification of the above versions of the invention provides additional strength, and requires extra plastic to construct, but does not otherwise alter the construction.

The previously described versions of the present invention have many advantages, including that of providing a sprinkler head protector that will protect sprinkler heads from damage caused by lawn mower blades and various types of wheeled vehicles.

The disclosed sprinkler head protector also tends to protect the sprinkler from damage that may result due to a settling of the soil in the area of the sprinkler head due compaction of soil that was loosened during the installation process.

The sprinkler head protector also prevents unwanted and overgrown grass, which may prevent the proper operation of the sprinkler head.

A further advantage of the present invention is to provide a sprinkler head protector that is suitable for either new construction or previously installed, existing, sprinkler heads.

Although the present invention has been described in considerable detail and with reference to certain preferred versions, other versions are possible. For example, while each of the embodiments disclosed provide four radially arrayed spikes, it is clear that a greater or lesser number would also be possible. Similarly, while the preferred embodiment of the invention provides an annular body having a curved upper surface, it is clear that surfaces having other shapes might also be usable. In particular, it is envisioned that sprinkler head protectors having one or two straight sides could be usable along sidewalks and in other areas where there is insufficient space for the above disclosed sprinkler head protectors. Therefore, the spirit, scope and dimensions of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A sprinkler head protector, adapted for placement about a sprinkler head, the sprinkler head protector comprising:

(A) an annular body defining a central hole sized for passage of the sprinkler head, the annular body comprising:

(a) a curved annular upper surface;

(b) a lower surface, adjacent to the curved annular upper surface, comprising web elements partially enclosing and defining hollow areas;

(c) the annular body defining a plurality of radially arrayed attachment holes, adapted for securing anchoring means to the annular body; and (d) a plurality of radially arrayed circular bosses, carried by the web elements, for providing strength in the areas adjacent to the attachment holes; and (B) wherein the anchoring means comprises a plurality of spikes, each spike carried by one of the plurality of attachment holes.

2. A sprinkler head protector, adapted for placement about a sprinkler head, the sprinkler head protector comprising:

(A) an annular body defining a central hole sized for passage of the sprinkler head, the annular body comprising:

(a) a curved annular upper surface, defining a plurality of counter sunk areas, each counter sunk area having an associated shoulder surface;

(b) a lower surface, adjacent to the curved annular upper surface, comprising web elements partially enclosing and defining hollow areas;

(c) a plurality of radially arrayed attachment holes passing entirely through the annular body, each attachment hole defined within the web elements of the lower surface of the annular body and having an upper opening defined within one of the shoulder surfaces; and (d) a plurality of radially arrayed bosses, each boss defined by web elements adjacent to one of the attachment holes, thereby providing increased structural strength; and (B) a plurality of spikes, each spike passing through an associated attachment hole and having a head portion sized to rest on the shoulder surface of a counter sunk area, wherein each spike provides a body portion extending from the lower surface and is adapted to secure the annular body in place.

* * * * *